United States Patent [19]

Puhak

[11] 4,009,411

[45] Feb. 22, 1977

[54] ALIGNMENT MEANS FOR ELECTRON GUN STRUCTURES

[75] Inventor: Peter George Puhak, Seneca Falls, N.Y.

[73] Assignee: GTE Sylvania Incorporated, Stamford, Conn.

[22] Filed: Feb. 20, 1976

[21] Appl. No.: 659,706

[52] U.S. Cl. ..... 313/456; 313/417

[51] Int. Cl.[2] ..... H01J 29/02; H01J 29/82

[58] Field of Search ..... 313/412, 417, 451, 456, 313/413, 414

[56] References Cited

UNITED STATES PATENTS

| | | | |
|---|---|---|---|
| 2,379,488 | 7/1945 | Koch et al. | 313/288 X |
| 2,431,137 | 11/1947 | O'Larte et al. | 313/451 |

*Primary Examiner*—Robert Segal
*Attorney, Agent, or Firm*—Norman J. O'Malley; Frederick H. Rinn; Robert T. Orner

[57] ABSTRACT

Improved means is provided for aligning an electron gun assembly of a cathode ray tube within the encompassing neck portion of the envelope. The alignment improvement is a one-piece crown-like structure comprising a band-like base member having a plurality of spaced-apart snubber projections extending in a substantially normal manner therefrom. The opposing ends of the base member are joined by adjustable jointure means to facilitate contiguous placement and bonding of the alignment means upon the terminal electrode of the gun assembly.

5 Claims, 8 Drawing Figures

ALIGNMENT MEANS FOR ELECTRON GUN STRUCTURES

BACKGROUND OF THE INVENTION

This invention relates to the electron gun assembly of a cathode ray tube and more particularly to an improvement in the means for aligning the electron gun assembly within the neck portion of a cathode ray tube envelope.

It has been conventional practice in the art to effect electron gun alignment within the neck portion of a cathode ray tube by individually affixing a plurality of separate longitudinal contact members to the forward end of the electron gun is a manner to extend outwardly therefrom to make contact with the wall of the surrounding neck portion of the envelope. Usually, each of these contact members, often referred to as snubbers, is separately attached to a terminal electrode member of the gun structure by at least a pair of adjacent welds. Individual placement of these snubber contact members often results in different outward angular positionings of the respective contacts. Thus, when the electron gun structure is subsequently positioned within the neck portion of the tube, the differences in angular positionings between the several contact members inhibits the desired alignment of the electron gun assembly relative to the encompassing portion of the envelope. In addition, the multiple welds required to individually bond each of the plurality of contact members is a time consuming operation.

OBJECTS AND SUMMARY OF THE INVENTION

It is an object of the invention to reduce and obviate the aforementioned disadvantages evidenced in the prior art. Another object of the invention is to provide a one-piece alignment structure that can be expeditiously attached to the terminal electrode of the electron gun assembly by a minimum number of welds to provide a uniformity of spaced alignment means therearound. It is a further object of the invention to provide a one-piece crown-like alignment unit that is constructed in an adjustable circumferential manner to effect discrete encompassment of the terminal electrode upon which it is oriented.

These and other objects and advantages are achieved in one aspect of the invention wherein there is provided an improvement in the means for aligning an electron gun assembly within the neck portion of a cathode ray tube envelope. The improved alignment means, which is formed for attachment to the terminal electrode of the gun assembly, is comprised of a one-piece band-like metallic base member having opposing ends which are discretely joined in a restricted, slidable, adjustable manner to form a closed and substantially circular unit. A plurality of spaced apart arm-like spacer contact projections extend from the band-like base member in a manner substantially normal thereto to form a crown-like unit. Each of these extending projections has a shank element contiguous to the base member and an integral terminal portion which is configurated to provide substantially non-abrasive contact with the surface of the neck portion of the tube envelope.

The base member of this crown-like unit is formed to have an internal circumferential dimension slightly greater than the related external dimensioning of the electrode is facilitate the telescopic placement of the base member thereon. The slidable adjustment of the base member enables it to be contiguous with and be bonded to the side wall of the electrode at a plurality of spatially related points therearound. Such points of affixture are spatially removed from the shank region, to effect uniform circumferential adjustment and attachment of the base member upon the electrode. Thus, the improved alignment means of the invention provides accurate spacing of the snubber contact projections, and similar circumferential orientation of each of the respective projections thereby effecting uniform tensioned placement of the array of terminal portions against the encompassing neck region. Accordingly, there is provided marked improvement in the alignment of the electron gun assembly therein.

DESCRIPTION OF THE PREFERRED EMBODIMENT

For a better understanding of the present invention, together with other and further objects, advantages, and capabilities thereof, reference is made to the following specification and appended claims in connection with the aforedescribed drawings.

While the invention is applicable for utilization in cathode ray tubes of conventional construction as employed in both monochrome and color television applications and similar image reproducing systems, for purposes of illustration, a color cathode ray tube utilizing a multi-apertured shadowmask and a plural beam electron generating assembly will be described in this specification.

Figure 1:
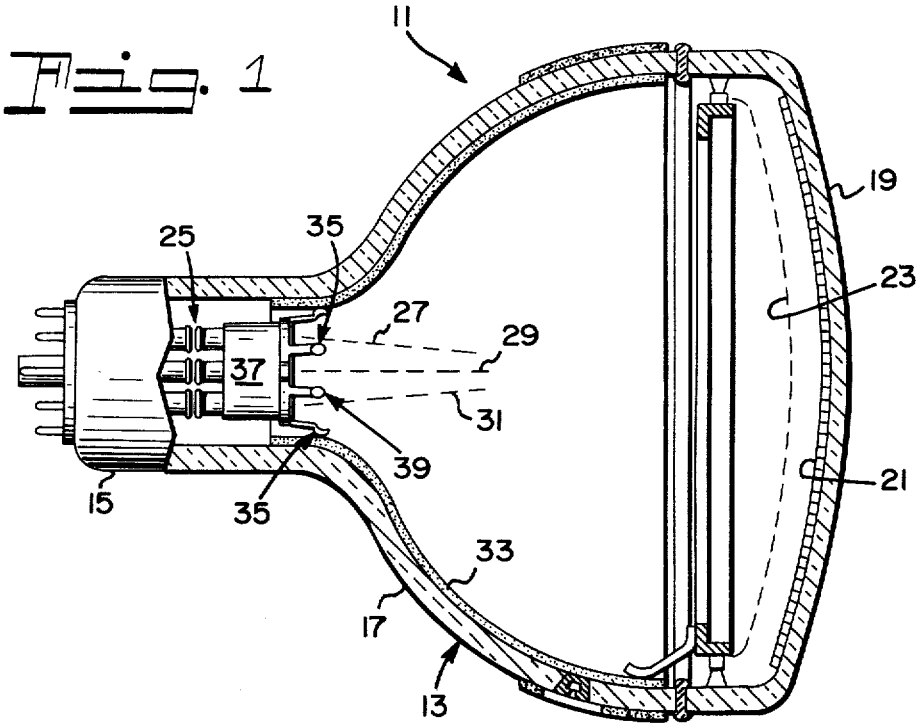
FIG. 1 is a sectional view of a cathode ray tube denoting the environment wherein the invention is concerned.
Figure 2:
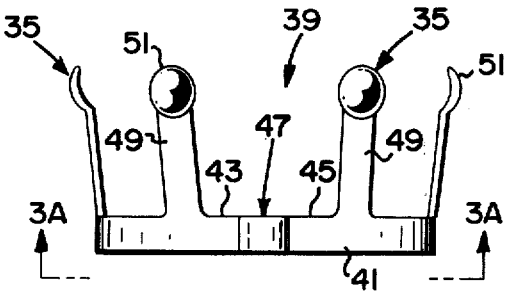
FIG. 2 is a side elevation of the improved alignment means illustrating the crown-like structure thereof.

With reference to the drawings, FIG. 1 illustrates a color cathode ray tube 11 having an envelope 13 comprised of an integration of neck 15, funnel 17, and viewing panel 19 members. A patterned cathodoluminescent screen 21, of diverse color emitting phosphor areas, is formed on the interior surface of the viewing panel 19 in keeping with the known state of the art. A multi-apertured structure 23, in this instance a shadow mask, is oriented within the viewing panel in spatial relationship to the patterned screen therein.

An exemplary and partially detailed plural beam electron gun structure 25 is positioned within the neck member 15 of the envelope and oriented to project a plurality of electron beams 27, 29 and 31 in a manner to effect convergence at the apertured mask 23 and thence impinge the patterned screen 21 therebeyond.

The interior surface of the funnel 17 has an electrical conductive coating 33 disposed thereon and extending therefrom into the neck member 15, whereat contact is made therewith by a plurality of similar, spaced-apart snubber contact projections 35 associated with the terminal electrode 37 of the electron gun assembly 25 oriented within the neck portion of the envelope.

The invention is an improvement in the means for aligning the electron gun structure 25 within the neck of the tube. As shown, the improved alignment and contact means 39 is formed as a crown-like structure which is attached to the terminal electrode element 37 of the electron gun assembly, it being in this instance the convergence cage component.

Figure 3A:
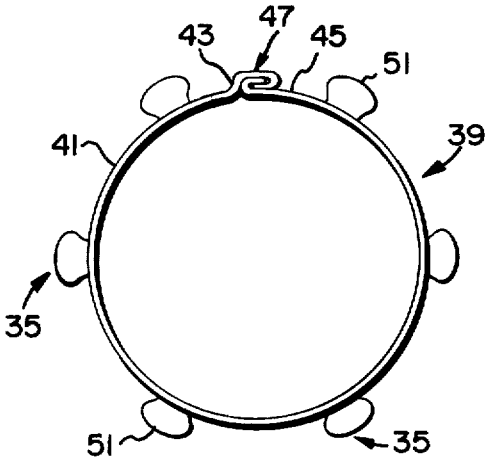
FIG. 3A is a plan view of the improved alignment means illustrated in FIG. 2 taken along the lines 3A–3A thereof.
Figure 3B:
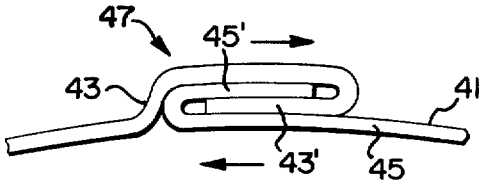
FIG. 3B is an enlarged view of the adjustable jointure portion of the invention.

Further details of the invention are delineated in FIGS. 2, 3A, 3B, 4 and 5. As illustrated, the improved alignment means 39 is comprised of a one-piece band-like metallic base member 41 having the opposite ends 43 and 45 thereof discretely joined in an adjustable manner to form a closed and substantially circular unit. The adjustable jointure 47, may be for example, a loose lock-seam formed by interlocking shaped ends 43' and 45' of the member in a manner to provide limited and related sliding movement of the related and compatibly configurated ends, as shown in FIG. 3B. The circular base member 41 is formed to have an internal circumferential dimension slightly greater than the related external dimensioning of the terminal electrode 37 to facilitate the telescopic placement of the base member 41 thereon. In referring to FIG. 5, sequential bonding or welding of the base member 41 to the sidewall of the circular electrode 37 at a plurality of spatially related points A – F therearound is accomplished prior to positioning of the gun assembly within the envelope. Such bonding effects circumferential adjustment of the encompassing base member 41 to the perimeter of the electrode, such being effected by the sliding of the shaped ends of the adjustable jointure 47 within limited confines of the loose or unswaged lock-seam construction. Integral with the base member 41 are a plurality of spaced apart arm-like snubbers or spacer contact projections 35 which extend therefrom in a manner substantially normal thereto to form a crown-like unit. Each of these contact projections 35 has a similar shank element 49 contiguous to the base member and an opposed integral terminal portion 51 which is configurated in a curved or spoon-like manner to provide substantially non-abrasive contact with the interior surface of the neck member 15 or the coating 33 disposed thereon. These contact projections 35 are collectively related in a spaced-apart manner and substantially parallelly related to the longitudinal axis of the tube whereof the terminal portions 51 conjunctively define a crown-like array having an external circumferential dimension that is greater than that of the base member 41 and the interior dimensioning of the neck portion 15. When the electron gun assembly 25 having this crown-like alignment means 39 terminally affixed thereto, is positioned within the neck portion of the tube, the greater circumferential dimensioning of the array of contact projections 35 effects tensioned placement of the multiple terminal portions 51 against the encompassing neck region 15 thereby providing uniform resiliency and positive alignment of the gun structure 25 therein.

Figure 4:
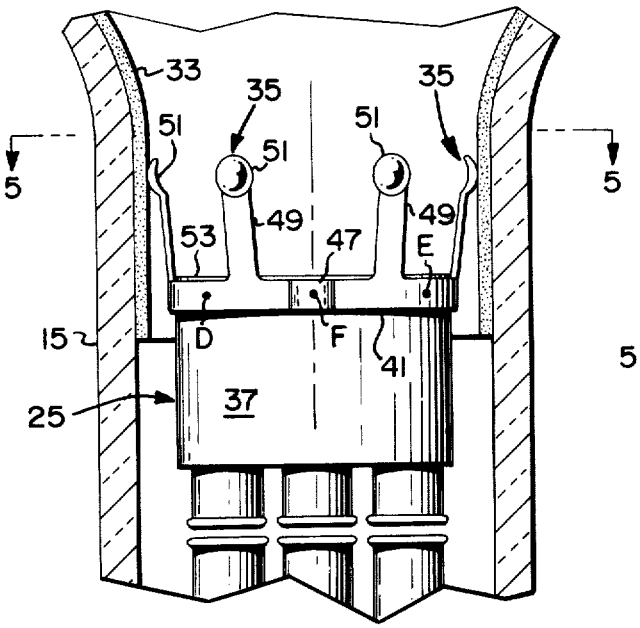
FIG. 4 is an enlarged section of FIG. 1 further detailing aspects of the invention.
Figure 5:
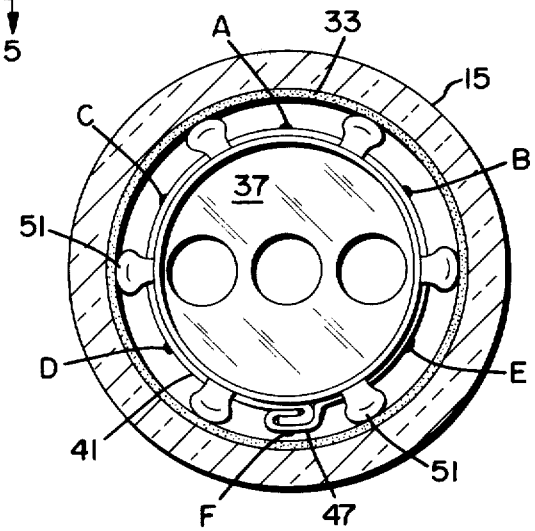
FIG. 5 is a plan view additionally illustrating the invention and the related structure taken along the line 5—5 of FIG. 4.
Figure 6:
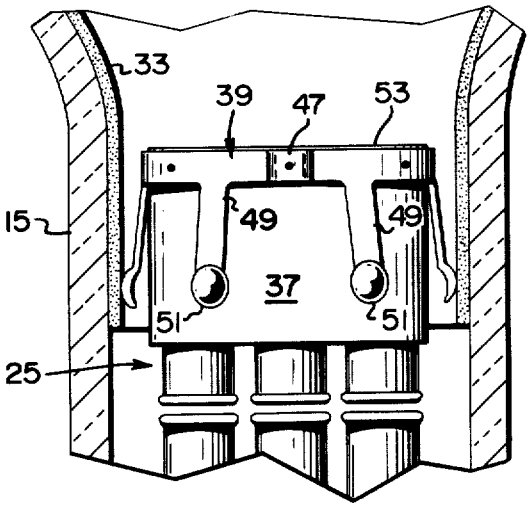
FIG. 6 is a partial sectional view similar to that of FIG. 4 wherein the alignment means of the invention is oriented in a downstanding manner.

As shown in FIGS. 1, 4, and 5, the improved alignment structure is affixed to the sidewall of the terminal electrode 37 to effect the placement of the contact projections 35 in a manner to extend beyond the forward boundary 53 of the terminal electrode 37. There are instances, such as in tubes having shorter neck portions and shorter gun assemblies, wherein the alignment means 39 is affixed to the sidewall of the terminal electrode 37 in a reverse manner to effect placement of the contact projections 35 in a manner to extend rearward from the forward boundary 53 of the terminal electrode; such downstanding orientation is illustrated in FIG. 6.

Figure 7:
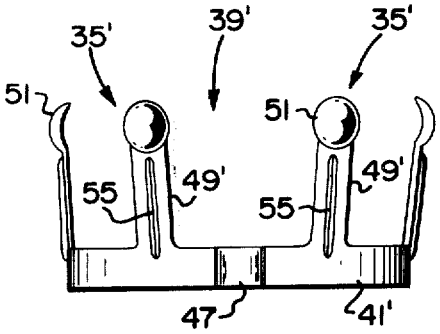
FIG. 7 is another embodiment of the structure of the invention illustrating the strengthening longitudinal embossments formed in each projection of the crown-like construction.

Another embodiment of the invention is the modified alignment means 39' as shown in FIG. 7, wherein each of the shank elements 49' of the contact projections 25' includes a longitudinal strengthening rib or embossment 55 which extends therefrom into the contiguously related area of the base member 41'. Such embossments 55 promote uniform tonic qualities to each of the respective contact projections 35', and effect similar positionings of all of the related projections of the crown-like array constituting the alignment means 39'.

To expeditiously accomplish attachment of the base member 39 to the terminal electrode 37, reference is directed to FIG. 5 wherein it is indicated that the first bond or weld therebetween is preferentially effected at a point A substantially diametrically distal from the adjustable lock seam jointure 47, such being a point substantially intermediate two adjacent contact projections. Additional welds are made on either side thereof, as for example, at points B, C, D, and E, each of which is substantially a mid-point between neighboring pairs of projections; proceeding in each instance peripherally toward the lock seam jointure 47. In this manner, the band-like base member 41 is snugly adjusted to the circumference of the terminal electrode 37. The final bond F is made preferably through the lock-seam 47 which is likewise substantially at a mid-point location between two adjacent contact projections. Thus, the crown-like alignment structure 39 is spatially affixed to the electrode 37 in a positive manner by a minimum number of related welds. The discrete placement of these welds, at substantially the mid-point between adjacent contact members, imparts to each contact projection a uniformity of positioning and tensioning potential, since the shank element 49 of each contact projection 35 has a similar supportive portion defined between related welds on the base member 41.

Thus, there is provided an improved alignment means for an electron gun assembly in a cathode ray tube that exhibits marked advantages over the prior art. The one-piece structure of the invention features an adjustable jointure which facilitates expeditious attachment to the terminal electrode of the electron gun structure with a minimum number of welds, and provides uniform resilient contact therearound to consummate the desired alignment of the gun structure within the encompassing neck portion of the tube.

While there has been shown and described what are at present considered the preferred embodiments of the invention, it will be obvious to those skilled in the art that various changes and modifications may be made therein without departing from the scope of the invention as defined by the appended claims.

What is claimed is:

1. Means for aligning an electron gun assembly within a cathode ray tube having a longitudinal axes, said alignment means being formed for attachment to said gun assembly having a terminal electrode element including a substantially cylindrical sidewall portion oriented within the substantially cylindrical neck region of said tube, said electron gun alignment means comprising:

a one-piece band-like metallic base member having opposing ends discretely joined in an adjustable loose, lock seam jointure to form a closed and substantially circular unit having limited end related movement and an internal circumferential dimension slightly greater than the related external dimensioning of said electrode to facilitate the telescopic placement and circumferential matching of said circular base member upon said terminal electrode and expedite bonding of said base member to the sidewall of said electrode at a plurality of spatially related points therearound thereby effecting circumferential adjustment and attachment of said encompassing base member thereupon; and a plurality of spaced apart arm-like spacer contact projections extending from said band-like member in a manner substantially normal thereto to form a crown-like unit, each of said projections having a shank element contiguous to said base member and an opposed integral terminal portion, said terminal portions being configurated to provide substantially non-abrasive contact with the surface of said neck, said contact projections being collectively related in a spaced apart manner and substantially parallelly related to the longitudinal axis of the tube whereof said terminal portions conjunctively define a crown-like array having an external circumferential dimension greater than that of said base member and interior of said neck to effect tensioned placement of the array of said terminal portions against the encompassing neck region to thereby provide alignment of said gun assembly therein.

2. Means for aligning an electron gun assembly according to claim 1 wherein said alignment means is affixed to the sidewall of said terminal electrode to effect the placement of said contact projections in a manner to extend beyond the forward boundary of said terminal electrode.

3. Means for aligning an electron gun assembly according to claim 1 wherein said alignment means is affixed to the sidewall of said terminal electrode to effect the placement of said contact projections in a manner to extend rearward from the forward boundary of said terminal electrode.

4. Means for aligning an electron gun assembly according to claim 1 wherein the bonding of said base member to the sidewall of said electrode element is effected at points substantially midway on the band between said contact projections to promote uniform resiliency of said contact projections.

5. Means for aligning an electron gun assembly according to claim 1 wherein each of the shank elements of the contact projections includes a longitudinal strengthening embossment therein extending therefrom into the contiguously related area of the base member to promote similar pressured positioning of all projections against said neck portion.

* * * * *